US006332296B1

(12) United States Patent
Moscovitch

(10) Patent No.: US 6,332,296 B1
(45) **Date of Patent: *Dec. 25, 2001**

(54) CORNER APPARATUS AND METHOD FOR FORMING CORNERS OF WALLBOARD CONSTRUCTED WALLS

(76) Inventor: Gerald Moscovitch, 59 Cowan Avenue, Toronto, Ontario (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/188,643

(22) Filed: Nov. 9, 1998

(51) Int. Cl.[7] ..... E04B 2/00; E04F 13/06

(52) U.S. Cl. ..... 52/287.1; 52/255; 52/417; 52/717.05; 52/745.11

(58) Field of Search ..... 52/287.1, 288.1, 52/718.02, 717.03, 717.05, 255, 417, 745.11, 716.1

(56) References Cited

U.S. PATENT DOCUMENTS

| | | | | |
|---|---|---|---|---|
| 2,227,581 | * | 1/1941 | Henderson | 20/74 |
| 2,882,564 | * | 4/1959 | Couse et al. | 20/92 |
| 3,086,328 | * | 4/1963 | Peterson et al. | 52/417 X |
| 3,090,087 | * | 5/1963 | Miller | 52/287.1 |
| 3,200,547 | * | 8/1965 | Johnson | 52/288 |
| 3,235,118 | * | 2/1966 | Kewley | 217/65 |
| 3,444,657 | | 5/1969 | Swanson . | |
| 3,964,220 | | 6/1976 | Rutkowski et al. . | |
| 3,989,397 | | 11/1976 | Baker . | |
| 4,012,878 | | 3/1977 | Ellingson . | |
| 4,198,455 | | 4/1980 | Spiro et al. . | |
| 4,313,991 | | 2/1982 | Lamb . | |
| 4,315,390 | | 2/1982 | Schaafsma . | |
| 4,553,363 | | 11/1985 | Weinar . | |
| 4,624,087 | | 11/1986 | Schneller . | |
| 4,719,732 | | 1/1988 | Bernard . | |
| 4,835,925 | * | 6/1989 | Hoffmann, Sr. | 52/287.1 |
| 4,863,774 | | 9/1989 | Tucker . | |
| 5,037,686 | | 8/1991 | Conboy . | |
| 5,045,374 | | 9/1991 | Tucker . | |
| 5,086,598 | | 2/1992 | Weldy . | |
| 5,131,198 | | 7/1992 | Ritchie et al. . | |
| 5,459,969 | | 10/1995 | Stibolt et al. . | |
| 5,531,050 | | 7/1996 | Stibolt et al. . | |
| 5,604,001 | * | 2/1997 | Schold | 52/287.1 X |

FOREIGN PATENT DOCUMENTS

| | | |
|---|---|---|
| 1215345 | 12/1970 | (IE) . |

* cited by examiner

*Primary Examiner*—Winnie S. Yip
(74) *Attorney, Agent, or Firm*—Harness Dickey & Pierce, P.L.C.

(57) ABSTRACT

A corner apparatus for forming inner or outer corner areas of wall structures. The apparatus comprises an elongated corner section having two planar panel portions attached by a living hinge. The two panel portions and living hinge are extruded from a high strength plastic. The living hinge enables the panel portions to be placed at a desired angle relative to each other to form an inner corner of a wall. When forming an outer corner, an elongated, generally L-shaped metal corner member is inserted into grooves formed in distal end portions of each of the planar panel portions of the corner section. This holds the planar panel portions in a desired angular orientation and provides a very straight corner edge for forming the outer corner area. The apparatus significantly reduces the time to form and finish corner areas of walls which are finished with drywall, thereby significantly reducing the cost of construction of the structure. The apparatus is lightweight, and can easily be laid flat for shipping purposes. In another preferred embodiment, various corner section members are used for forming a corner between three perpendicular wall sections which meet, such as two vertical walls and a ceiling.

15 Claims, 5 Drawing Sheets

CORNER APPARATUS AND METHOD FOR FORMING CORNERS OF WALLBOARD CONSTRUCTED WALLS

BACKGROUND OF THE INVENTION

1. Technical Field

This invention relates to apparatuses for forming corners of drywall or wallboard constructed wall segments, and more particularly to a method and apparatus for forming inner and outer corners between two drywall or wallboard sections during a construction process.

2. Discussion

In the construction of buildings it is now common to use drywall or wallboard (hereinafter simply referred to as "drywall") on the interior of the structure to finish interior walls of the structure. The edges of adjacent sections which meet along a flat portion of a wall or ceiling (i.e., not at a corner) are relatively easy to finish, even by individuals without expertise in drywall finishing. The edges are tapered such that when two drywall sections are positioned adjacent one another a "cove" or depression is formed. The cove is first filled with mud and then tape is pressed into the mud along the full length of the cove. More mud is then placed over the tape before the first sanding of the resulting joint is performed.

When finishing corner areas where two sections of drywall meet and form a corner, however, the finishing process is time consuming and highly dependent upon the skill of the drywall finisher. The corner area, whether an interior or exterior corner, has to be taped, mudded and then sanded. The mudding and sanding process is usually performed several times, even by an experienced and highly skilled drywall finisher, before the corner joint takes on the appearance of a cleanly, integrally formed corner area with no visually perceptible joint areas. The corner areas are especially difficult to form at the areas where the walls meet the ceiling of a structure. As will be appreciated, this adds to the overall cost of constructing any structure where drywall is used and increases the time needed for drywall finishing.

The above finishing process can be particularly troublesome for home remodeling applications undertaken by "do-it-yourself" persons. By this term, it is meant those individuals who do not have extensive experience in working with drywall finishing and have not acquired the necessary skill to finish inner and outer corner areas of a structure in a manner that produces clean, well-finished corner areas free from visual imperfections. Whereas the portions of adjacent drywall panels that meet at a flat point along a wall or ceiling can usually be finished adequately by even a "do-it-yourself" person, the inner and outer corner areas are usually very difficult and time consuming for such persons to finish.

When forming outer corners between two drywall sections, it has previously been necessary to nail or screw a metal corner section over the corner before taping and mudding the corner. Obviously, the metal corner member has to be attached carefully such that it forms a straight vertical edge. If this component is not attached properly, a "wavy", non-linear edge will be formed, requiring even further finishing efforts.

It is therefore a principal object of the present invention to provide an apparatus and method for enabling inner and outer drywall corners to be quickly and easily constructed without having to tape and mud these corner areas when working with drywall panels.

It is still a further object of the present invention to provide an apparatus and method which is inexpensive to produce, easy to ship and install, and which further does not add appreciably to the overall construction costs when working with drywall panels, and which further enables the drywall finishing process to be performed much more quickly and efficiently.

It is still another object of the present invention to provide an apparatus and method which can be readily adapted for forming either an inner corner or an outer corner area between two drywall panels, with the only requirement being the use or non-use of an additional metal member which is attached to the apparatus before the apparatus is installed in the corner area to thereby form a clean, straight vertical corner line over which taping and mudding may be performed.

It is still a further object of the present invention to provide a corner apparatus which enables rounded inner or outer corners to be formed without any mudding and taping at the corners.

SUMMARY OF THE INVENTION

The above and other objects are provided by a corner apparatus and method in accordance with preferred embodiments of the present invention. The corner apparatus, in one preferred embodiment, comprises a pair of extruded plastic panel portions which are attached by a thin, living hinge. The two panel portions and the living hinge are extruded from high strength plastic to form a relatively low cost, lightweight assembly that can be laid flat for shipping purposes. Each of the panel portions has a thickness of preferably either ⅜" or ½", depending upon the thickness of the drywall panels with which the apparatus is intended to be used to form a corner area. Each of the panel portions further has an outer surface and an inner surface, with each of these surfaces having a slightly tapered distal end portion to allow the edges of each panel portion to be blended in with adjacently positioned drywall panels to form a clean corner area with no visually perceptible joint lines. Thus, the only finishing required is along the outer distal ends of each of the panel portions which meet adjacently positioned drywall sections, which are relatively easily and quickly finished.

In the preferred embodiment the inner ends of each panel portion are formed with a groove extending the entire length thereof. The groove accepts the arm portions of a metal corner member. The arm portions of the metal corner member are slid into the grooves which lock the two panel portions in a corner configuration. The metal corner member itself presents a very straight longitudinal outer corner edge which does not need to be nailed or screwed to the panel portions. Taping and mudding may then be performed more accurately and easily, even by unskilled persons, to form a clean, straight outer corner edge.

The apparatus of the present invention does not require the above-mentioned metal corner member if an interior corner is being formed. In that instance, the panel portions are simply secured to studs in the corner area. Each of the front and rear surfaces of the panel members further include drywall paper laminated thereon so no finishing is needed whatsoever at the inner corner formed by the two panel portions. The living hinge enables the panel portions to be secured at a range of angles relative to each other in the event that the inner corner formed is not a perfect 90° corner.

In yet another alternative preferred embodiment, two panel portions are provided which are connected by a thin flexible section of plastic along the entire length of each panel. The thin section of plastic permits a rounded inner or outer corner to be formed. The two panel portions comprise sections of plastic which are also extruded with the thin flexible section as a single piece component which is lightweight and which can be laid flat for shipping purposes.

Various corner assemblies are also disclosed for more quickly and easily forming a corner at the intersection of three perpendicular wall sections. Assemblies for forming ninety degree corners and radiused corners are both disclosed.

The various preferred embodiments enable inner and outer corners of wall structures to be more easily and quickly finished by either a professional drywall installer or by an individual without extensive drywall finishing experience. The various preferred embodiments further enable angled or rounded corners to be easily created.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
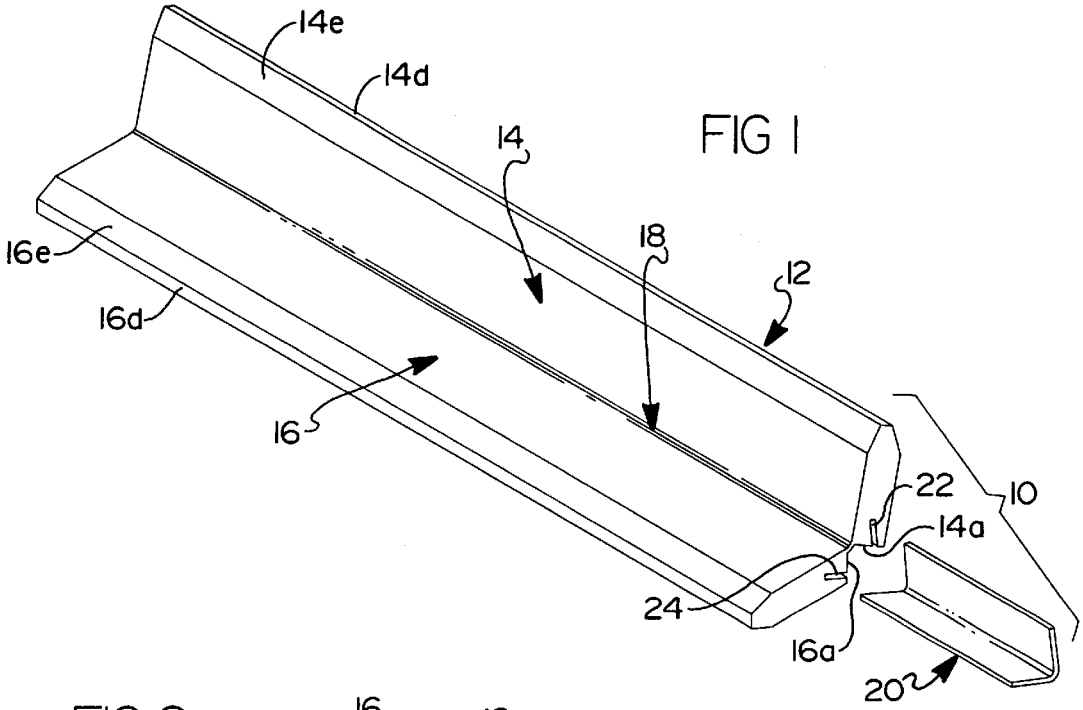
FIG. 1 is a perspective view of a corner apparatus in accordance with the present invention.

Referring to FIG. 1, there is shown a corner apparatus 10 in accordance with a preferred embodiment of the present invention. The corner apparatus 10 generally comprises a section 12 having a first planar panel portion 14 and a second planar panel portion 16 connected by a thin living hinge 18 which extends along the entire length of the panel portions 14 and 16. Preferably, the entire corner section 12 is extruded as a single piece component from a suitably high strength plastic such as polypropylene. As will be discussed further, the apparatus 10 further includes a generally L-shaped metal corner member 20 which is attached to the corner section 12 when the apparatus 10 is being used to form an outer corner. Component 20, however, is not needed when corner section 12 is used to form an interior corner of a wall area.

Figure 2:
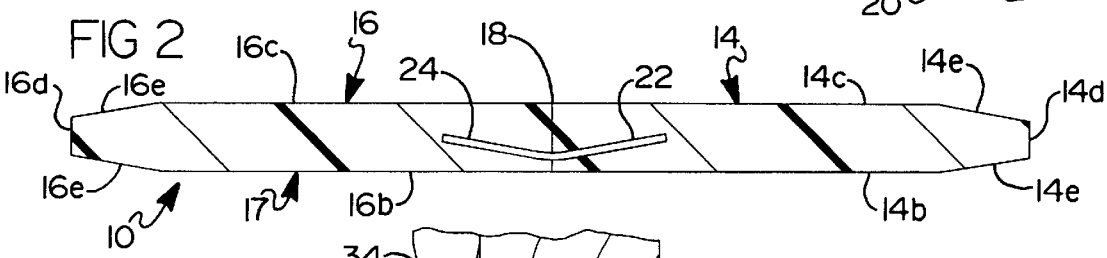
FIG. 2 is an end view of the apparatus of FIG. 1 with the corner apparatus laid completely flat.
Figure 3:
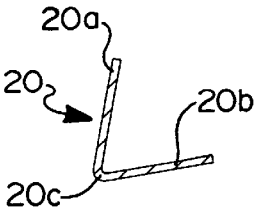
FIG. 3 is an end view of the metal corner member of the apparatus.

Referring further to FIGS. 1 and 2, panel portion 14 includes a groove 22 formed in a distal end portion 14*a*, where the groove 22 extends along the entire length of the panel portion 14. Similarly, panel portion 16 includes a groove 24 formed in a distal end portion 16*a* thereof which extends along the entire length of panel portion 16.

The panel portion 14 further includes a front surface 14*b* and a rear surface 14*c*. Panel portion 16 similarly includes a front surface 16*b* and a rear surface 16*c*. A distal end 14*d* of panel portion 14 includes tapered areas 14*e* forming "coves" or depressions to help in blending the panel portion 14 in with an adjacently positioned portion of drywall. Similarly, panel portion 16 includes a distal end portion 16d having tapered portions 16*e* which form coves to help in blending in the distal end portion 16*d* with an adjacently positioned section of drywall when taping and mudding the joint between these panels. Each of the front and rear surfaces 14*b*, 14*c* and 16*b*, 16*c* of each panel portion further have drywall paper 17 laminated thereon.

The metal corner member 20 includes arm portions 20*a* and 20*b* and a corner edge portion 20*c*. Arm portions 20*a* and 20*b* are adapted to be slid into the grooves 22 and 24 from one end of the panel portions 14, 16 when the apparatus 10 is being used to form an outer corner of a wall. Thus, the metal corner member 20 does not need to be secured with drywall screws or nails to any adjacent section of drywall.

Figure 4:
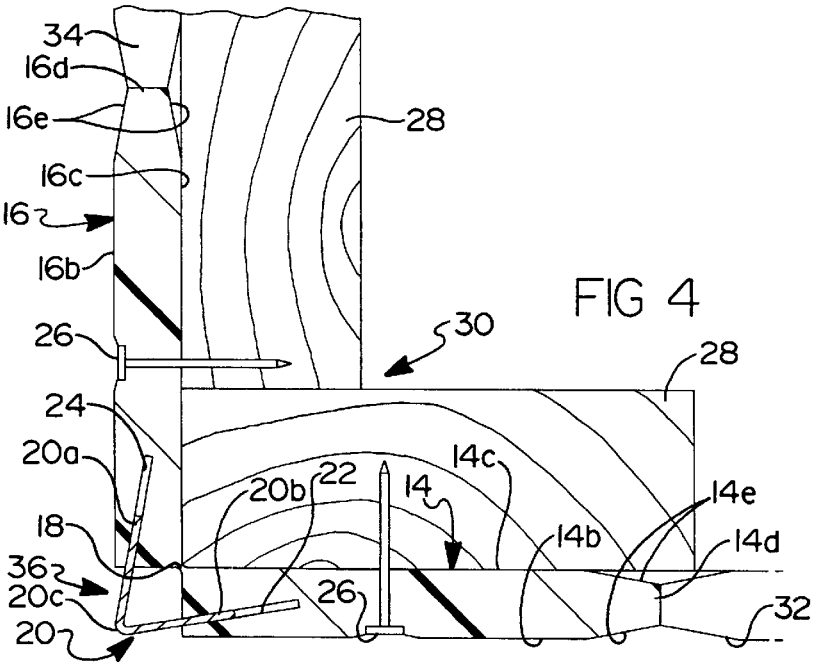
FIG. 4 is a view of the apparatus coupled to a pair of studs illustrating how the apparatus for an outer corner of a wall.

Referring now to FIG. 4, the metal corner member 20 is illustrated attached to the panel portions 14 and 16. Each of the panel portions 14 and 16 are further secured either by nails or threaded drywall screws 26 to wooden studs 28 at the corner area of a wall structure 30 formed by the studs. The corner edge 20*c* provides an extremely straight edge which is used with conventional taping and mudding techniques to provide a corner for the wall area. The material which the panel portions 14 and 16 are constructed from also preferably allows a slight degree of deformation to be produced around the head of each nail or drywall screw 26 when the nail or screw is driven through its associated panel portion 14 or 16 tightly into a supporting wood stud 28. This allows the head to be driven down into the panel portion 14 or 16 slightly such that the head is slightly below the outer surface of the panel 14 or 16. This enables these areas to be patched easily during the finishing process. Polypropylene allows for this slight degree of deformation.

With further reference to FIG. 4, in use the metal corner member 20 is inserted into the grooves 22, 24 which holds the panel portions 14, 16 at the desired angular orientation. The panel portions 14 and 16 are then secured to the studs 28 and additional drywall sections 32, 34 are abutted up against the distal ends 14*d*, 16*d* of the panel portions 14, 16. Taping and mudding is then performed to finish the outer corner area 36 and the joints between the drywall sections 32, 34 and the distal ends 14*d*, 16*d* of the panels 14, 16.

It will be appreciated that the corner section 12 can be extruded in different lengths to meet the needs of specific applications. The panel portions 14, 16 and the living hinge 18 could be co-extruded from different materials if desired to lower material costs or weight. It is anticipated that in most instances the corner section 12, together with the metal corner member 20, will be cut to lengths of 8 feet, 10 feet or 12 feet, which are most commonly used in the construction industry. Each of the panel portions 14 and 16 preferably has a width of about 2.0"–3.0", but it will be appreciated that this dimension could be varied as needed. The thickness of each panel portion 14, 16 is selected to match that of the drywall being used. In most instances this will be either, 0.375 inch, 0.5 inch or 0.625 inch, which are the thicknesses of drywall most commonly used. Preformed openings could also be included for the drywall screws or nails 26 at points along the length of each panel portion 14 and 16 if desired. The metal corner member 20 may be made from other suitably strong materials which can be formed in a generally L-shaped configuration, or in any other desired angular configuration.

Figure 5:
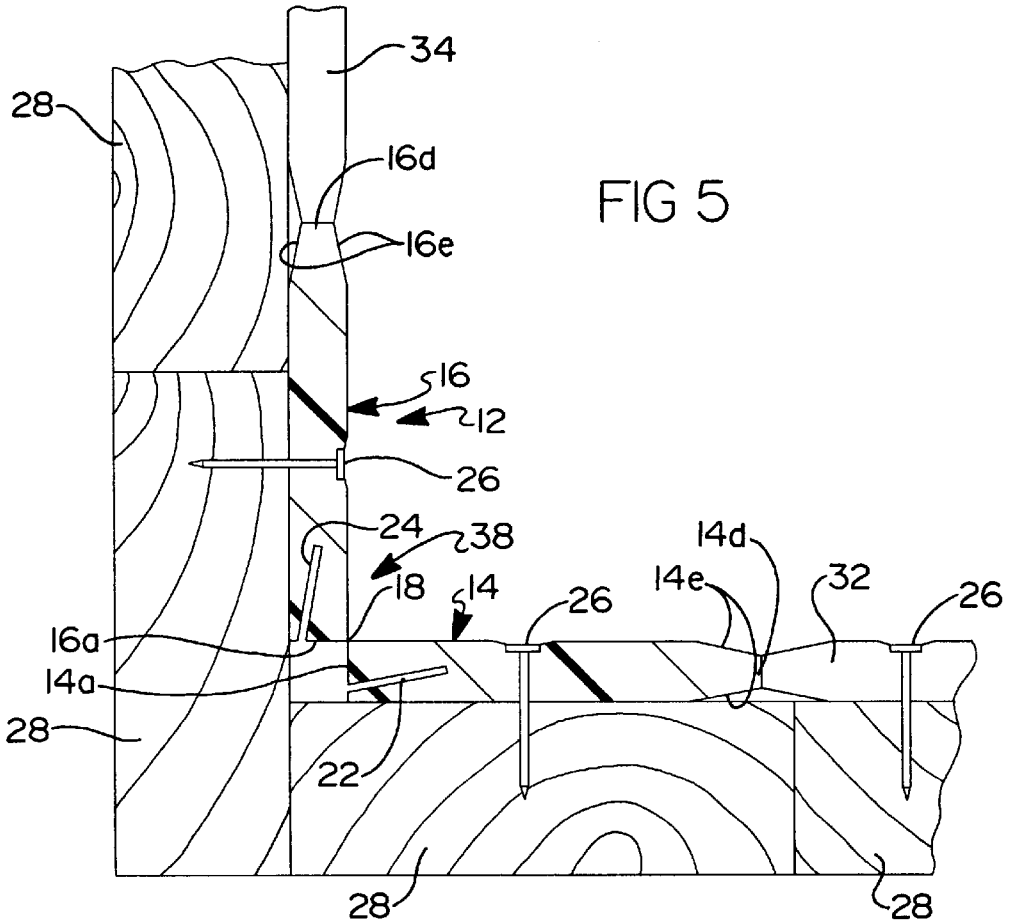
FIG. 5 is an illustration showing how the corner apparatus forms an inner corner of a wall assembly.

Referring now to FIG. 5, the apparatus 10 is shown being used to form an inner corner area 38. The living hinge 18 of the corner section 12 allows the panel portions 14 and 16 to be articulated into a 90° angle and placed in the corner area 38 against the wood studs 28. The living hinge 18 further permits the angle between the panel portions 14 and 16 to be adjusted as needed in the event a corner which is not precisely 90° is being finished. It will also be appreciated that when forming an inner corner area such as shown in FIG. 5, the metal corner member 20 will not be needed. However, the corner member 20 could just as easily be incorporated as illustrated in FIG. 4 to abut the corner of the wall and provide additional support to the area defined by the living hinge 18, if so desired.

Figure 6:
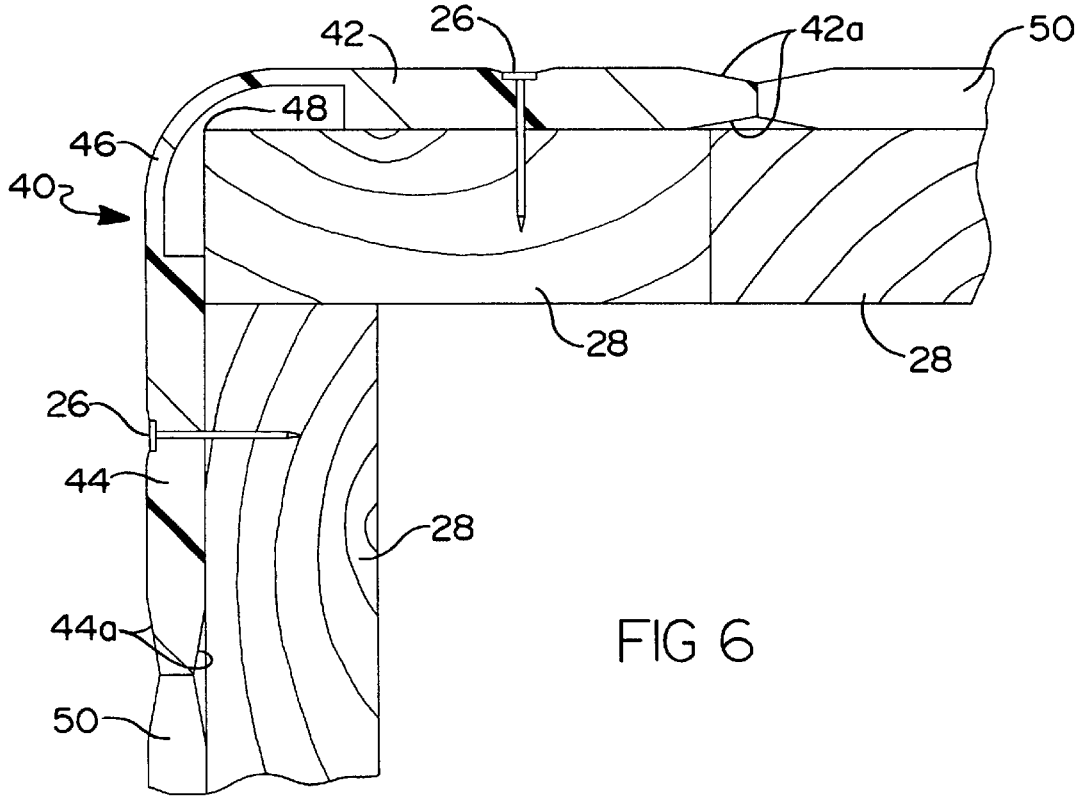
FIG. 6 illustrates an alternative preferred embodiment of the corner apparatus wherein the corner apparatus is used to form a rounded outer corner for a wall structure.

Referring now to FIG. 6, a corner apparatus 40 in accordance with an alternative preferred embodiment of the present invention is illustrated. The apparatus 40 comprises panel portions 42 and 44 which are substantially identical to panel portions 14 and 16 of the corner section 12, with the principal difference being that instead of a thin living hinge 18, an elongated, thin length of plastic 46 is formed between the panel portions 42 and 44. The panel portions 42, 44 and the plastic connecting section 46 also have drywall paper laminated thereon on all surfaces. The length of plastic 46 is flexible such that either a rounded inner corner or a rounded outer corner can be formed.

The desired radius of curvature can be obtained by manufacturing apparatuses 40 having varying lengths of plastic portions 46 as needed to enable corner portions to be formed having a precise radius of curvature. For example, manufacturing the corner apparatus 40 with a connecting section 46 having a length of 1 inch could allow a corner to be formed having a 0.5 inch radius of curvature, whereas a length of 2 inches could enable a 1.0 inch radius of curvature corner to be formed. Thus, any desired radius of curvature could be accommodated by providing either a longer or shorter plastic connecting section 46. Depending upon the thickness of the connecting section 46 and the material the apparatus is constructed from, the radius of curvature could also be adjusted simply by moving the panel portions 42 and 44 closer to a corner edge 48 of one of the studs 28 at the corner of the wall section.

The panel portions 42 and 44 each include tapered surfaces 42*a* and 44*a*, respectively, to enable them to be readily blended in with adjacently positioned drywall panels 50. The panel portions 42, 44 and the thin plastic connecting section 46 are preferably extruded from high strength plastic such as polypropylene to form a single component which can be laid flat for shipping purposes. If desired, the connection section 46 and the panel portions 42, 44 could be co-extruded from different materials to either reduce material cost or weight.

Figure 9:
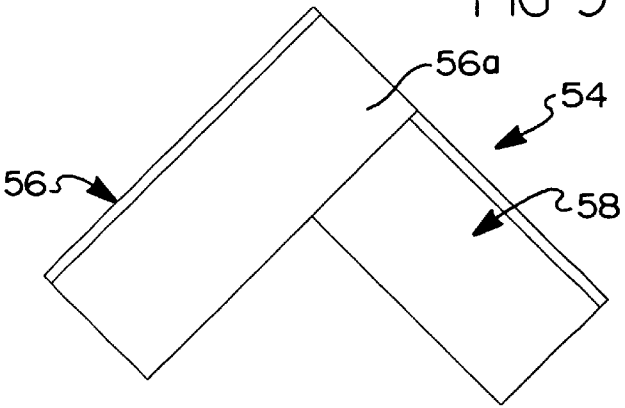
FIG. 9 is a plan view of the assembled components shown in FIG. 8.
Figure 8:
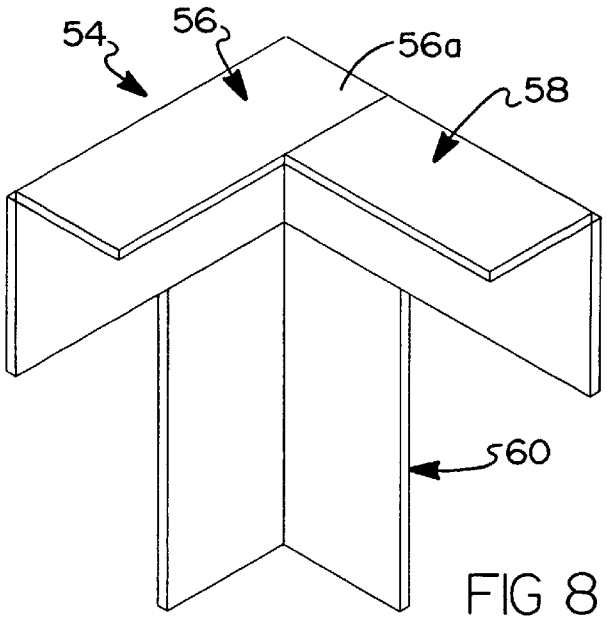
FIG. 8 is a perspective view of the assembled components shown in FIG. 7.
Figure 7:
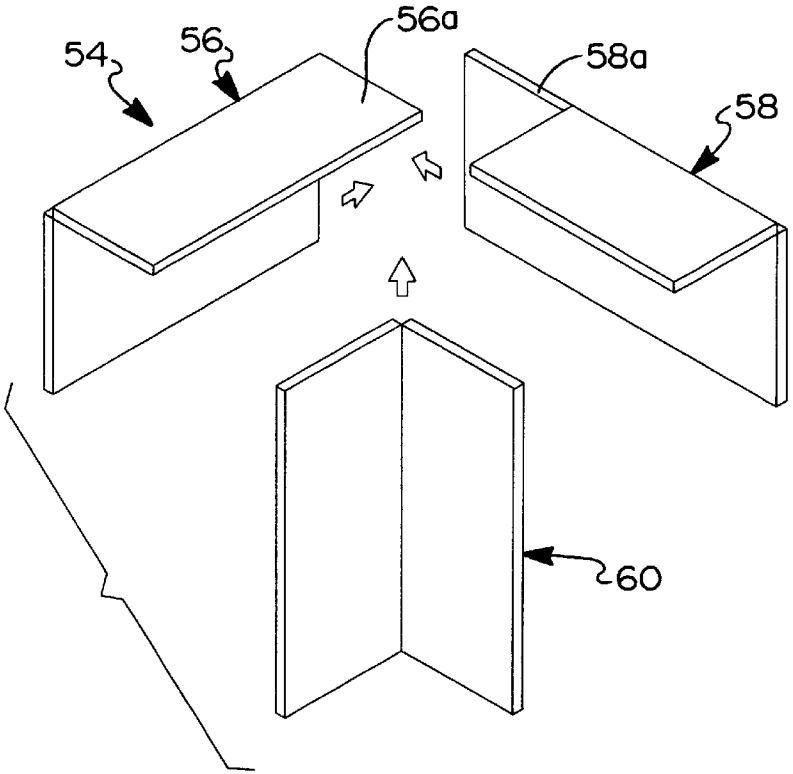
FIG. 7 is an exploded perspective view of the components making up a corner apparatus suitable for forming a corner joint at a point where three wall portions meet.

Referring now to FIGS. 7–9, a corner assembly 54 is shown which includes three corner sections 56, 58 and 60. Sections 56 and 58 are adapted to interengage to form a clean wall/ceiling interface, and section 60 abuts portions of sections 56 and 58 to complete the three way corner. To facilitate the engagement of sections 56 and 58, section 58 includes a notched portion 58*a*. Notched portion 58*a* allows a corner portion 56*a* of section 56 to blend in with section 58, as seen in FIGS. 8 and 9. Thus, the components enable a corner area at the intersection of three perpendicular walls to be formed quickly and easily. It will be appreciated that each of components 56, 58 and 60 may be identical in construction to section 12 shown in FIG. 1 but need not incorporate the grooves 22 and 24. If the grooves 22 and 24 are incorporated, however, the metal corner member 20 could also be used to provide support to the living hinge area of the component incorporating the grooves. Also, while components 56, 58 and 60 have been illustrated without the tapered portions 14*e* and 16*e*, it will be appreciated that these tapered surfaces could, and in most cases will, be incorporated on sections 56, 58 and 60 to facilitate blending in with adjacently positioned drywall panels.

Figure 12:
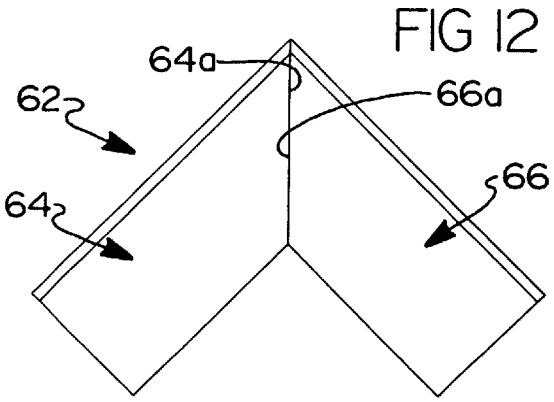
FIG. 12 is a plan view of the assembled corner components shown in FIG. 11.
Figure 11:
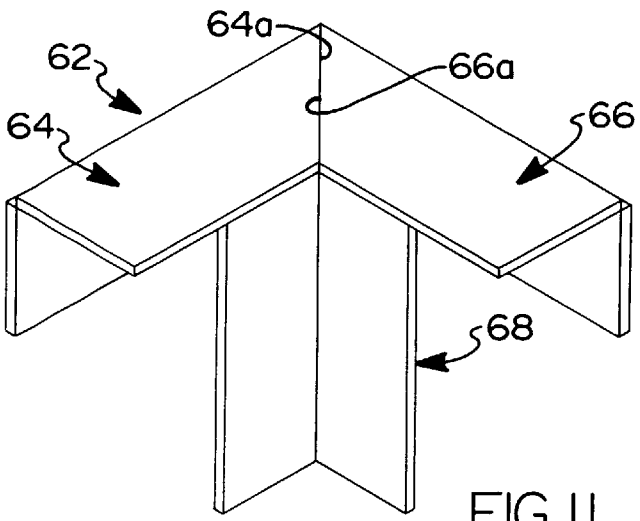
FIG. 11 is an assembled perspective view of the components shown in FIG. 10.
Figure 10:
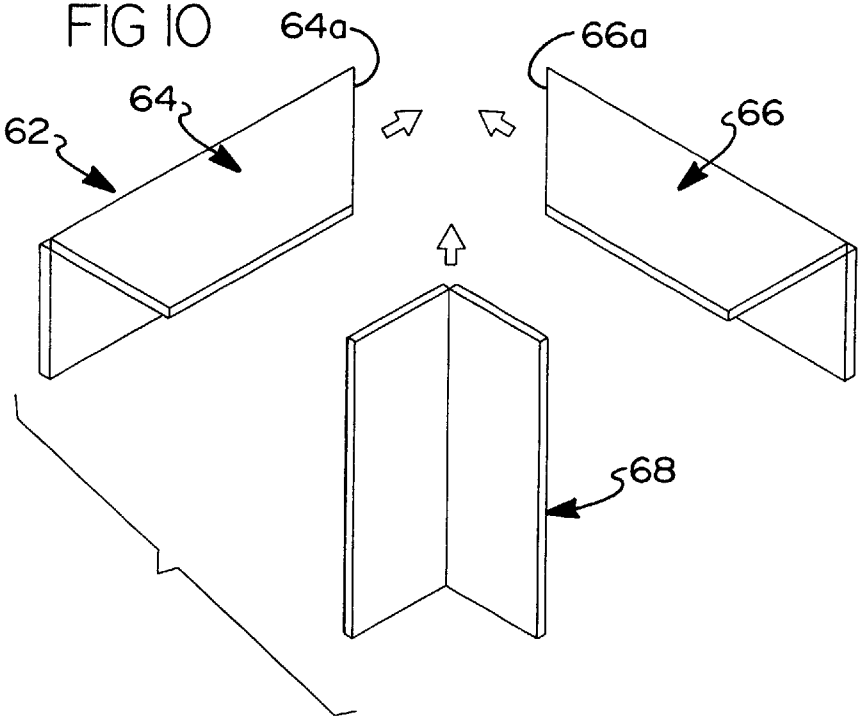
FIG. 10 is an exploded perspective view of the components making up a corner apparatus suitable for forming a corner joint at a point where three wall portions meet, where two of the components have a mitered corner for forming a 90 degree corner therebetween.

Referring now to FIGS. 10–12, another corner assembly 62 is illustrated. Corner assembly 62 comprises corner sections 64, 66 and 68 which are each identical to sections 56, 58 and 60, respectively, with the exception of the mitered corners 64*a* and 66*a* of sections 64 and 66, respectively. The assembled components 64, 66 and 68 are shown in FIGS. 11 and 12. Again, components 64, 66 and 68 could incorporate the tapered edge portions 14*e* and 16*e* shown in FIG. 1 if desired. It would also be possible to form each of components 64 and 66 with scribe lines defining the mitered corners 64*a* and 66*a*, which would enable a user to precisely cut the mitered corners with a utility knife.

Figure 15:
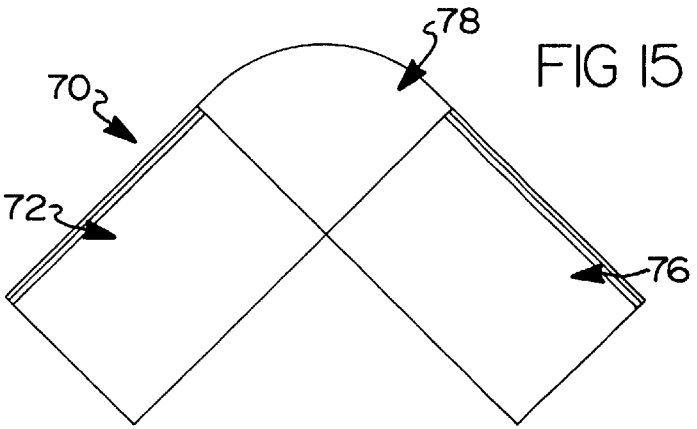
FIG. 15 is a plan view of the assembled components shown in FIG. 14.
Figure 14:
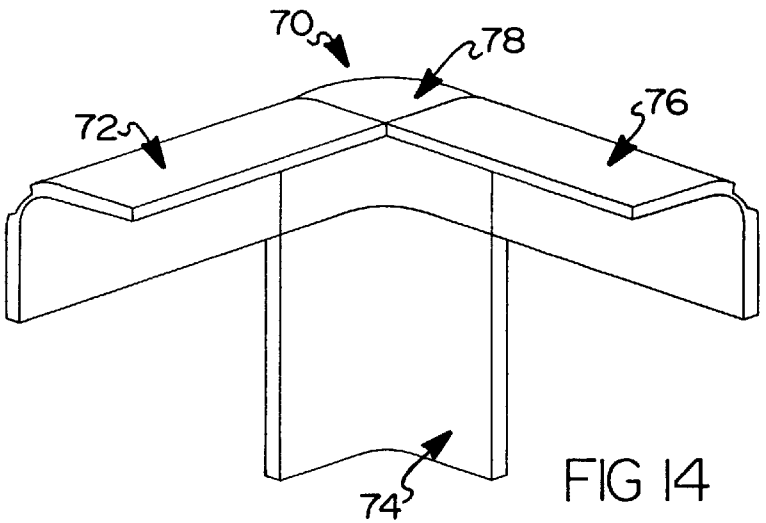
FIG. 14 is an assembled perspective view of the components of FIG. 13.
Figure 13:
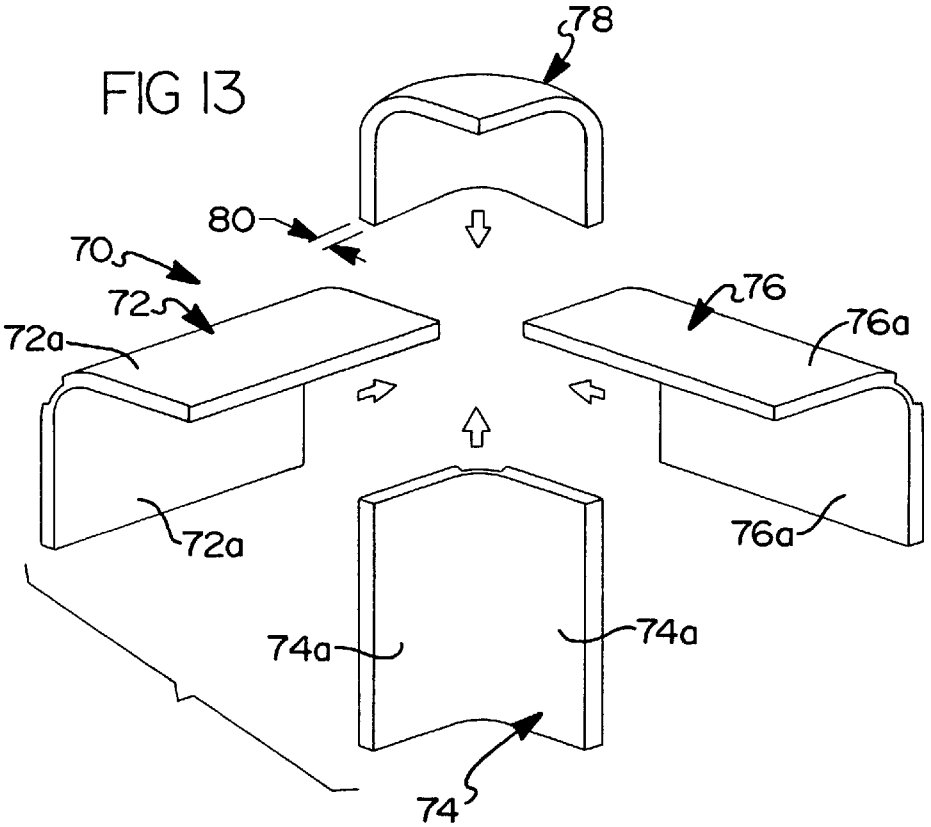
FIG. 13 is an exploded perspective view of the components used to form a corner at an area where three wall portions meet, and where the corner formed is a rounded or radiused corner.

Referring now to FIGS. 13–15, another corner assembly 70 is illustrated for forming a radiused corner where three perpendicular walls meet. Assembly 70 includes corner sections 72, 74, 76 and 78. Sections 72, 74 and 76 are identical in construction to corner apparatus 40 of FIG. 6. Section 78 is preferably a one-piece molded member which may be formed from the same material as sections 72, 74 and 76 or, alternatively, from a different material. Of course, the thickness of this member, as defined by dimensional arrows 80, should be the same as the thickness of the panels 72*a*, 74*a* and 76*a* of components 72, 74 and 76 so that the member 78 will blend in smoothly with the surfaces of components 72, 74 and 76. It will also be appreciated that tapered edges such as edges 14*e* and 16*e* shown in FIG. 1 could be incorporated with each of components 72, 74 and 76. Further, each of the corner sections shown in FIG. 7–15 are preferably covered with laminated on drywall paper.

Each of the embodiments shown herein could be formed with scalloped or relief portions in one surface thereof to save material costs. In this instance, it would be necessary to designate a corner apparatus as an "inner" or "outer" section so that the surface having the scalloped or relief portions can be placed against the studs 28 (FIGS. 4–6) during installation and will therefore not be visible, and will not require additional finishing efforts.

It will also be appreciated that the use of the various preferred embodiments described herein will require that the corner areas be addressed first by attaching the components of the present invention at the inner and outer corner areas of a structure. Subsequently, the larger drywall panels may be installed such that their edges abut the edges of the corner sections described herein. This is generally the opposite of the traditional drywall construction process, which typically involves placing large drywall sheets up to form the walls first, and then forming the corners of intersecting perpendicular walls.

Each of the preferred embodiments described herein provides a quick and easy means for forming inner and outer corner areas of wall structures. The preferred embodiments of the present invention eliminate or substantially simplify taping and mudding at the corner areas of wall structures, which is typically a very time consuming operation requiring highly skilled drywall finishing persons. Thus, the overall cost of construction is reduced because the entire drywall finishing process can be performed in less time. Furthermore, even individuals without extensive drywall finishing experience can construct clean, professional looking corners using the preferred embodiments of the invention described herein. The ability to lay the panel portions of each apparatus described herein flat for shipping purposes further enables the apparatus to be shipped and handled easily. Moreover, each of the preferred embodiments can be quickly installed at a work site with little or no modifications to standard construction procedures.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A corner apparatus adapted to be secured to a corner area of a wall structure to form a finished appearing corner, said apparatus comprising:

a first planar panel portion;

a second planar panel portion;

a living hinge formed between said first and second panel portions to enable said panel portions to be bent to a desired angle relative to each other;

each of said panel portions having a front surface and a rear surface;

each of said front and rear surfaces including tapering edge surfaces adjacent distal ends thereof to facilitate blending of said distal ends with adjacently positioned wallboard sections positioned abuttingly against each of said distal ends when taping and mudding said corner area during a construction process.

2. The apparatus of claim 1, wherein each of said panel portions includes an inner edge adjacent said living hinge; and wherein said inner edge of each said panel portion includes a generally longitudinal groove formed therein; and wherein said apparatus further includes a metal corner member having a pair of planar panels adapted to slide into said grooves in said panel portions to hold said panel portions at a predetermined angle relative to each other and to form a corner edge for said wall structure on which tapping and mudding may be performed.

3. The apparatus of claim 2, wherein said metal corner member is formed as a generally L-shaped member.

4. The apparatus of claim 1, wherein said apparatus is extruded from plastic and able to be positioned flat for shipping purposes.

5. A corner apparatus adapted to be secured to a corner area of a wall structure to form a finished appearing corner, wherein the apparatus can be used to form an inner corner or an outer corner of said wall structure as needed, said apparatus comprising:

a first planar panel portion;

a second planar panel portion;

a living hinge formed between inner ends of said panel portions such that the angle of said panel portions relative to each other may be adjusted as needed to form an inner corner or an outer corner;

said first and second panel portions and said living hinge being formed from plastic to form a single component which may be laid flat for shipping purposes; and each of said panel portions including a distal end portion and front and rear surfaces, each of said front and rear surfaces having tapered portions adjacent said distal end portions to facilitate taping and mudding so as to enable said panel portions to be blended in with adjacently positioned wallboard portions positioned abuttingly against each of said distal ends.

6. The apparatus of claim 5, wherein said inner ends of said panel portions each have a groove formed therein; and wherein said apparatus further includes a generally L-shaped corner member having arm portions insertable into said grooves, said corner member operating to form an outer corner edge over which mudding and taping may be performed.

7. The apparatus of claim 6, wherein said L-shaped corner member comprises a metal corner member.

8. The apparatus of claim 5, wherein said apparatus is extruded as a single piece component from plastic and able to be easily laid flat for shipping purposes.

9. The apparatus of claim 5, wherein said front and rear surfaces of said panel portions are laminated with wallboard paper.

10. A corner apparatus adapted to be secured to a corner area of a wall structure to form a finished appearing corner, wherein the apparatus can be used to form an inner corner or an outer corner of said wall structure as needed, said apparatus comprising:

a first planar panel portion;

a second planar panel portion;

a living hinge formed between inner ends of said panel portions such that the angle of said panel portions relative to each other may be adjusted as needed to form an inner corner or an outer corner;

said first and second panel portions and said living hinge being formed from plastic to form a single component which may be laid flat for shipping purposes;

each of said panel portions including a distal end portion and front and rear surfaces, each of said front and rear surfaces having tapered portions adjacent said distal end portions to facilitate taping and mudding so as to enable said panel portions to be blended in with adjacently positioned wallboard portions;

each of said panel portions including inner end portions adjacent said living hinge, each of said inner end portions having a longitudinal groove formed therein; and an L-shaped corner member having arm portions adapted to slide into said grooves to form an outer corner edge, said L-shaped corner member being incorporated when said outer corner is to be formed at said wall structure.

11. The apparatus of claim 10, wherein said panel portions and said living hinge are extruded from plastic as a single component and able to be laid flat for shipping purposes.

12. The apparatus of claim 11, wherein said L-shaped corner member comprises a metal corner member.

13. The apparatus of claim 12, wherein said front and rear surfaces of said panel portions are laminated with wallboard paper.

14. A method for forming a quickly installable corner apparatus which eliminates a need for forming a corner edge at a corner area of a wall structure during construction of said wall structure, said method comprising the steps of:

providing a first, elongated planar panel portion having a groove formed in one edge thereof;

providing a second, elongated, planar panel portion having a groove formed in one edge thereof;

proving a living hinge area integrally formed with said panel portions;

providing an L-shaped corner member;

inserting edge portions of said L-shaped corner member in said grooves to form a corner edge;

placing said panel portions and said attached L-shaped corner member in said corner area such that said L-shaped corner member forms said corner edge; and securing said panel portions to a portion of said wall structure.

15. A corner apparatus adapted to be secured to a corner area of a wall structure to form a finished appearing corner, wherein the apparatus can be used to form an inner corner or an outer corner of said wall structure as needed, said apparatus comprising:

a first planar panel portion;

a second planar panel portion;

a living hinge formed between inner ends of said panel portions such that the angle of said panel portions relative to each other may be adjusted as needed to form an inner corner or an outer corner;

said first and second panel portions and said living hinge being formed from plastic to form a single component which may be laid flat for shipping purposes; and each of said panel portions including a distal end portion and front and rear surfaces, each of said front and rear surfaces being laminated with wallboard paper and having tapered portions adjacent said distal end portions to facilitate taping and mudding so as to enable said panel portions to be blended in with adjacently positioned wallboard portions.

* * * * *